United States Patent [19]

Kako et al.

[11] Patent Number: 4,984,553

[45] Date of Patent: Jan. 15, 1991

[54] FUEL CONTROL APPARATUS FOR AN INTERNAL COMBUSTION ENGINE

[75] Inventors: Hajime Kako; Shinji Kojima, both of Himeji, Japan

[73] Assignee: Mitsubishi Denki Kabushiki Kaisha, Tokyo, Japan

[21] Appl. No.: 520,934

[22] Filed: May 9, 1990

[30] Foreign Application Priority Data

May 22, 1989 [JP] Japan ..... 1-129257

[51] Int. Cl.[5] ..... F02D 41/18

[52] U.S. Cl. ..... 123/494; 123/488; 123/492

[58] Field of Search ..... 123/478, 480, 493, 486, 123/488, 492, 494, 339; 364/431.05, 510

[56] References Cited

U.S. PATENT DOCUMENTS 4,475,518 10/1984 Kashiwaya et al. ..... 123/494
4,558,678 12/1985 Nishimura et al. ..... 123/494
4,702,214 10/1987 Wataya ..... 123/494 X
4,899,713 2/1990 Nakamura ..... 123/478
4,911,133 3/1990 Sogawa ..... 123/478 X
4,919,100 4/1990 Nakamura ..... 123/492
4,945,883 8/1990 Ono et al. ..... 123/494

*Primary Examiner*—Willis R. Wolfe
*Attorney, Agent, or Firm*—Sughrue, Mion, Zinn, Macpeak and Seas

[57] ABSTRACT

A fuel control apparatus for an internal combustion engine which comprises a pressure detecting means for detecting a pressure in a bypass air passage which bypasses a throttle valve in an air intake system for an internal combustion engine, a first estimating means for estimating a value corresponding to the effective cross-sectional area of the bypass air passage, a second estimating means for estimating a pressure in an intake air pipe of the air intake system on the basis of a pressure value detected by the pressure detecting means and an estimated value of effective cross-sectional area obtained by the first estimating means, and an operating means for calculating a fuel injection quantity on the basis of an estimated value of pressure in the intake air pipe which is obtained by the second estimating means.

2 Claims, 13 Drawing Sheets

FUEL CONTROL APPARATUS FOR AN INTERNAL COMBUSTION ENGINE

BACKGROUND OF THE INVENTION

1. Field of the Invention

The present invention relates to a fuel control apparatus for an internal combustion engine wherein a pressure in an intake air pipe (hereinbelow, referred to as an intake air pipe pressure) is estimated and a fuel injection quantity is calculated on the basis of a value determined by the intake air pipe pressure.

2. Discussion of Background

A conventional fuel control apparatus for an internal combustion engine will be described with reference to FIG. 1 which is also used for describing an embodiment of the present invention.

FIG. 1 shows an engine which is subjected to a speed density type SPI (single-point-injection) fuel control, wherein a reference numeral 1 designates an internal combustion engine, a numeral 3 designates an intake air pipe, a numeral **3*b* designates a throttle body, a numeral 4 designates a throttle valve, a numeral 5 designates a sensor for detecting a degree of opening of the throttle valve (hereinbelow, referred to as a throttle sensor), a numeral 6 designates a bypass air passage, a numeral 7 designates a wax type first idle air valve (hereinbelow, referred to as an FIA valve) used for fast idling, a numeral 11 designates an ON/OFF type air conditioner idle-up solenoid valve (hereinbelow, referred to as an ACIUS valve) used for air conditioning idling-up, a numeral 12 designates a switch for air conditioner, a numeral 13 designates a duty-controlled idle speed control solenoid valve (hereinbelow, referred to as an ISC solenoid valve) used for adjusting a revolution number in idling, a numeral 14 designates a pressure sensor, a numeral 15 designates a fuel injector, a numeral 16 designates an ignition coil, a numeral 18 designates an exhaust pipe, a numeral 20 designates a branch pipe for exhaust gas, a numeral 21 designates a control valve for recirculating exhaust gas (hereinbelow, referred to as an EGR valve), a numeral 22 designates an exhaust gas recirculating port, and a numeral 23** designates a water temperature sensor.

Exhaust gas recirculated into the exhaust gas recirculating port 22 contains a water component. Accordingly, it is necessary to form a pressure introducing port at the upper stream side to the exhaust gas recirculating port 22 in order to prevent the water component from entering into the pressure sensor 14. However, when the pressure introducing port is formed in the main passage of the throttle body **3*b*, fuel may enter through the pressure introducing port. Therefore, the pressure introducing port for the pressure sensor 14 is formed in the bypass air passage 6** in order to prevent the invasion of the water component and fuel.

A numeral 25 designates a control unit which receives signals from the throttle sensor 5, the pressure sensor 14, the ignition coil 16, the water temperature sensor 23 and so on; processes the signals, and actuates the ISC solenoid valve 13 and the fuel injector 15.

The operation of the conventional fuel control apparatus will be described with reference to an operating flow chart in FIG. 22 which is stored as a form of program in the control unit 22.

At Steps S1, S2, S3 and S4, an engine revolution number, an intake air pipe pressure, a cooling water temperature and a degree of opening of a throttle valve are respectively detected, and digital signals indicating an actual revolution speed Ne, an intake air pressure value Pb', a cooling water temperature value WT and a throttle opening value $\theta$ are sequentially read at each time of detection.

At a Step S5, controlled variables for the ISC solenoid valve 13 are calculated so as to control the revolution number in the idling operation, if there is found an idling operation on the basis of the operational conditions such as an engine revolution number, a throttle valve opening degree and so on.

At a Step S6, a volumetric efficiency $C_{EV}$(Ne, Pb') is calculated by using a two-dimensional map prepared by using data of the revolution number Ne and the intake air pipe pressures Pb'.

At Step S7, an engine warming-up increment coefficient $C_{WT}$(WT) is calculated by using the obtained coOling water temperature value (TW).

At Step S8, a driving time $\tau$ for driving the fuel injector 15 is calculated in accordance with an equation $\tau = K \times Pb' \times C_{EV} \times C_{WT}$ (where K is a constant).

After Step S8, sequential operation is returned to Step S1 to thereby repeat the above-mentioned steps.

In the conventional fuel control apparatus having the above-mentioned construction, a pressure loss is resulted because the bypass air passage 6 is thin. With the result of this, a pressure difference results between an intake air pipe pressure at the inlet port of a conduit for introducing pressure for the pressure sensor 14 and an intake air pipe pressure at the exterior side of the outlet port of the bypass air passage 6, whereby the pressure sensor 14 detects a pressure higher than the actual intake air pipe pressure. In particular, the pressure difference is greater when the specific gravity of air flowing the bypass air passage 6 is large, or a flow rate of air in the passage 6 is large. More particularly, the pressure difference becomes the maximum when the engine 1 is at a low temperature. Therefore, when a fuel injection quantity is calculated on the basis of an intake air pipe pressure value Pb' obtained by the pressure sensor 14, the air-fuel ratio tends to be at a rich side since the fuel injection quantity is calculated to be more than the quantity corresponding to the actual intake air pipe pressure value. In particular, when the engine is at a low temperature, the air fuel ratio becomes excessively rich, which causes the reduction of fuel consumption efficiency, drivability and so on.

SUMMARY OF THE INVENTION

It is an object of the present invention to provide a fuel control apparatus for an internal combustion engine capable of calculating an appropriate fuel injection quantity by estimating an actual intake air pipe pressure.

The foregoing and other objects of the present invention have been attained by providing a fuel control apparatus for an internal combustion engine which comprises a pressure detecting means for detecting a pressure in a bypass air passage which bypasses a throttle valve in an air intake system for an internal combustion engine, a first estimating means for estimating a value corresponding to the effective cross-sectional area of the bypass air passage, a second estimating means for estimating a pressure in an intake air pipe of the air intake system on the basis of a pressure value detected by the pressure detecting means and an estimated value of effective cross-sectional area obtained by the first estimating means, and an operating means for calculating a fuel injection quantity on the basis of an estimated value of pressure in the intake air pipe which is obtained by the second estimating means.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
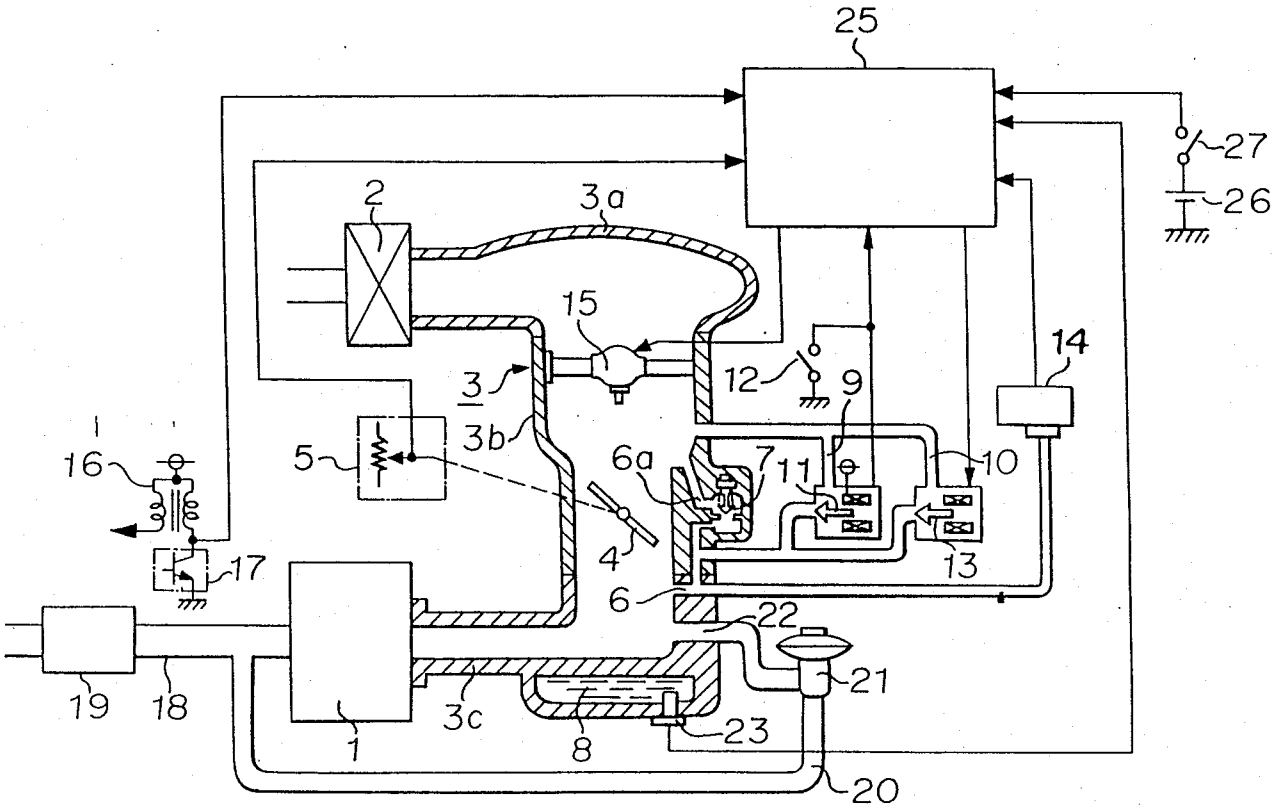
FIG. 1 is a diagram showing an embodiment of the fuel control apparatus according to the present invention.

Referring to the drawings, wherein the same reference numerals designate the same or corresponding part throughout the several views, and more particularly to FIG. 1 thereof, there is shown a diagram of a typical example of the fuel control apparatus of the present invention. In FIG. 1, air for combustion is sucked into a spark ignition type internal combustion engine 1 through an air cleaner 2, an intake air pipe 3 and a throttle valve 4. The intake air pipe 3 is composed of an air intake portion *3a*, a throttle body portion *3b* whose cross-sectional area of the inner portion is adjusted by operating the throttle valve 4 and an intake air manifold *3c*. A throttle valve opening degree sensor 5 detects a degree of opening of the throttle valve 4 and outputs a detection signal corresponding to the degree of opening of the throttle valve.

An FIA passage *6a* is formed so as to be communicated with the bypass air passage 6 whose inlet port opens at the upstream side of the throttle valve 4 and whose outlet port opens at the downstream side of the valve 4 so that the passage *6a* bypasses the throttle valve 4 provided in the throttle body portion *3b*. A wax type FIA valve 7, which is disposed in the FIA passage *6a* of the bypass air passage 6, is automatically operated so as to adjust the cross-sectional area of the FIA passage *6a* depending on the temperature of the cooling water 8 of the engine 1; thus, a flow rate of air flowing in the bypass passage is partially controlled. The bypass air passage 6 has another inlet port which opens in the throttle body portion *3b* at a position which is further upstream side of the first inlet port. The second inlet port of the bypass air passage 6 is communicated with an A/C (air conditioner) bypass passage 9 and an ISC (idle speed control) bypass passage 10 connected in parallel to each other. A common outlet port of these passages 9, 10 is formed in the throttle body portion *3b* at the downstream side of the FIA valve 7 of the FIA passage *6a*. An ACIUS valve 11 is provided in the A/C bypass passage 9 to control the cross-sectional area of the passage 9. The ACIUS valve 11 is fully opened or closed in response to an ON or OFF of a switch 12 for an air conditioner, whereby the flow rate of air flowing the bypass passage 6 is partially controlled.

An ISC solenoid valve 13 is to control the cross-sectional area of the ISC bypass passage 10, and the degree of opening of the ISC solenoid valve 13 is adjusted in response to the duty ratio of a driving signal. For instance, a flow rate of air flowing in the bypass passage is partially controlled so that an engine revolution number during an idling operation reaches a target revolution. Thus, the cross-sectional area of the bypass air passage 6 (the effective cross sectional area of the bypass air passage), i.e. a flow rate of air passing through the passage is controlled by the FIA valve 7, the ACIUS valve 11 and the ISC solenoid valve 13. The air passing through the bypass air passage 6 is fed to the engine 1 so that it is used for combustion.

A pressure introducing port for the pressure sensor 14 is formed in the bypass air passage 6 at the downstream side of te common outlet port of the both bypass passages 9, 10. The pressure sensor 14 detects a pressure in the intake air pipe 3 (an intake air pipe pressure) at the absolute pressure by detecting a pressure in the bypass air passage 6, and outputs a detection signal corresponding to the detected intake air pipe pressure.

The fuel injector 15 as an independent structural element connected to a fuel supplying system (not shown) is placed at the upstream side of the throttle body portion **3*b* with respect to the inlet port of the bypass air passage 6 so that it ejects fuel in an amount corresponding to an amount of sucked air to be supplied to the engine 1 in order to effect combustion. The fuel ejected is mixed with the sucked air and the mixed gas is introduced into the engine 1**.

The primary winding of an ignition coil 16 is connected to a transistor which constitutes the final stage of an igniter 17 connected to a power source and an ignition control system. A high voltage is supplied to an ignition plug (not shown) provided for each cylinder in the engine through the secondary winding of the ignition coil 16 to thereby effect ignition.

A part of exhaust gas discharged from the engine 1 is discharged outside through an exhaust pipe 18 in which a catalyst 19 is held to remove harmful components. An exhaust gas branching pipe 20 is connected to the exhaust pipe 18 so that a part of the exhaust gas branched by the branching pipe 20 is introduced in the intake air pipe 3 to be recirculated to the engine 1 through an exhaust gas recirculating port 22 located at the downstream side from the outlet port of the bypass air passage 6 via an EGR valve 21.

A water temperature sensor 23 detects the water temperature of the cooling water 8 and outputs a detection signal corresponding to the detected water temperature.

Figure 2:
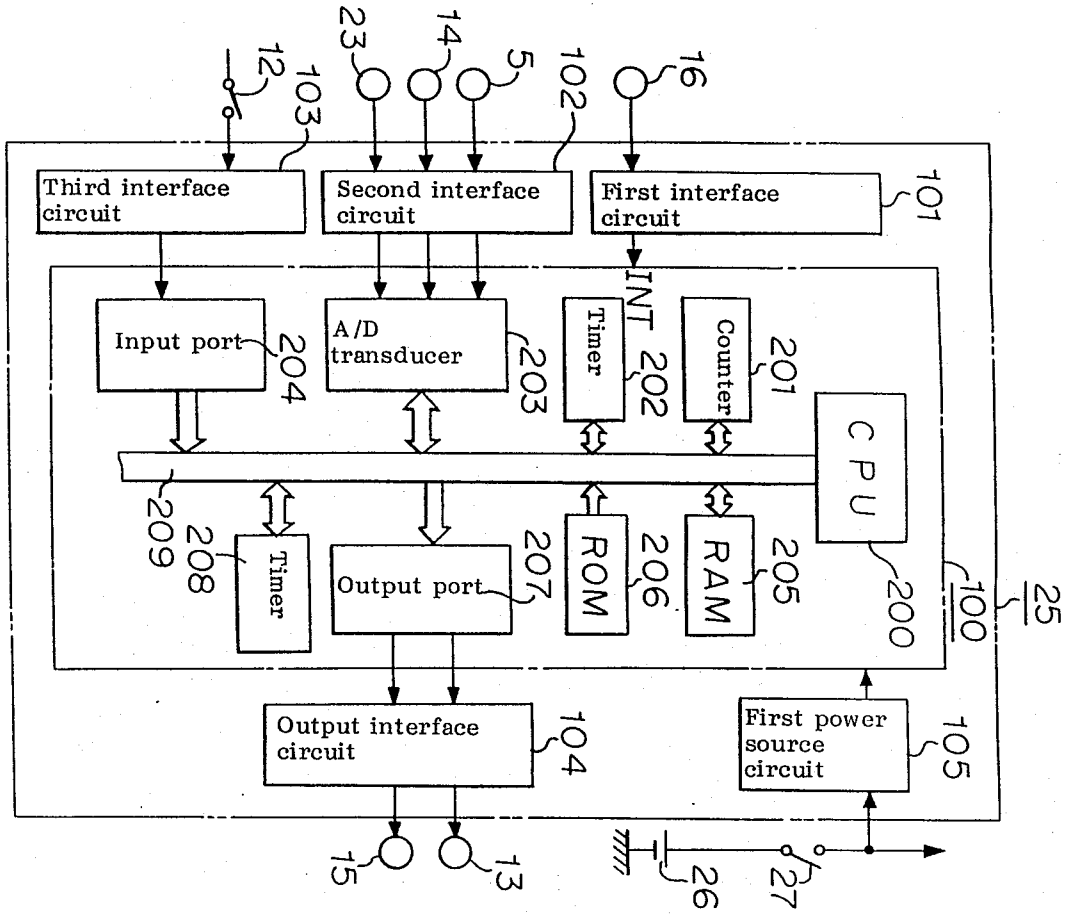
FIG. 2 is a block diagram showing an embodiment of the construction of the control unit as shown in FIG. 1.

FIG. 2 is a block diagram of a control unit 25. The control unit 25 is so constructed that it starts operations upon receiving power from a battery 26 when a key switch 27 is actuated; receives ON/OFF signals from the switch for air conditioner 12, signals produced at the primary winding side of the ignition coil 16 and analogue detection signals from the throttle valve opening degree sensor 5, the pressure sensor 14 and the water temperature sensor 23; estimates a correct intake air pipe pressure by conducting predetermined processes; calculates a fuel injection quantity on the basis of the estimated pressure value; calculates an idling revolution number controlling quantity; generates a signal of opening the fuel injector 15 in accordance with a result of calculation, and controls the operation of the ISC solenoid valve 13.

Figure 3:
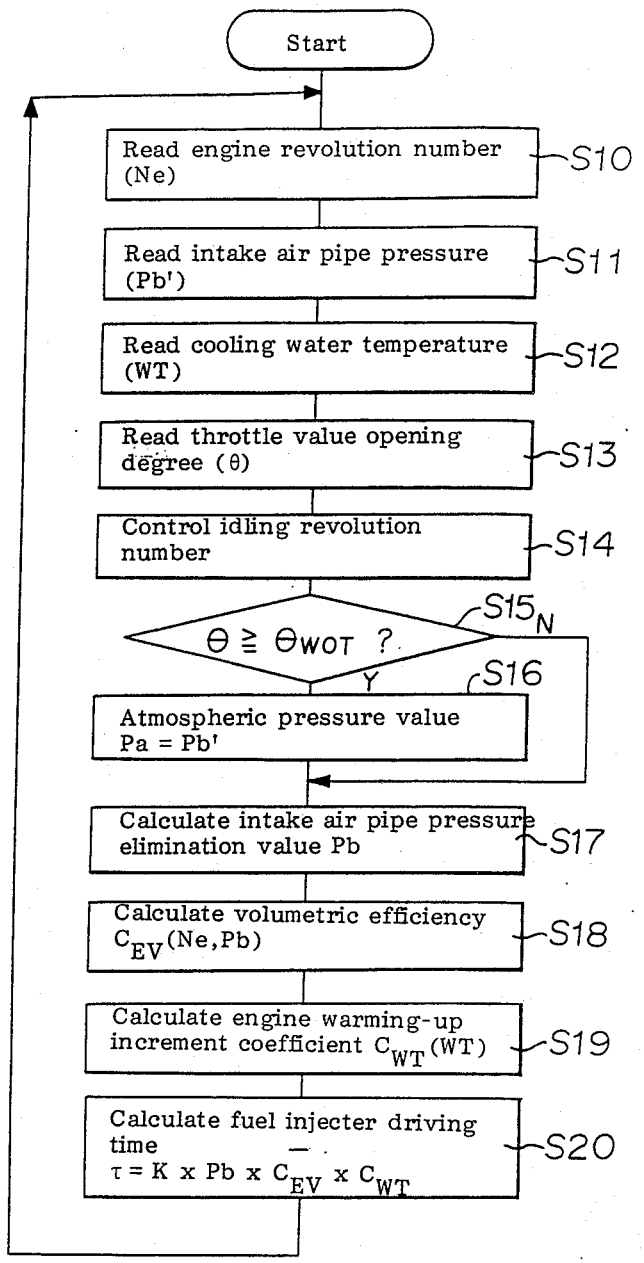
FIG. 3 is a flow chart showing the main operation of the control unit in the first embodiment of the present invention.

In FIG. 2 which shows the inner structure of the control unit 25, a microcomputer 100 is constituted by a CPU 200 for conducting various calculations and judgments, a counter 201 for measuring revolution period, a timer 202 for measuring driving time, an A/D transducer 203 for transducing an analogue input signal into a digital signal, an input port 204 which receives the digital signal to transmit it to the CPU 200, a RAM 205 functioning as a work memory, a ROM 206 which stores programs such as a main flow as shown in FIG. 3 and various kinds of map, an output port 207 which outputs a command signal from the CPU 200, a timer 208 for measuring the duty ratio of a driving signal which is supplied to the ISC solenoid valve 13, a common bus 209 and so on.

An ignition signal generated at the primary winding side of the ignition coil 16 is subjected to waveform shaping by a first input interface circuit 101 so that it is rendered to be an interruption command signal to be inputted into the microcomputer 100. Whenever the interruption command signal is generated, the CPU 200 of the microcomputer 100 reads a value generated from the counter 201 and calculates a revolution period from the difference value between the value at the previous time and the read value. Then, the microcomputer 100 calculates a revolution number datum Ne representing an engine revolution number. Analogue input signals generated from the throttle valve opening degree sensor 5, the pressure sensor 14 and the water temperature sensor 23 are supplied to the A/D transducer 203 through the second input interface circuit 102 where the output signals are subjected to the removal of noise components and amplification. The analogue output signals are converted in the transducer 203 into a throttle valve opening degree value $\theta$ (where a detected degree of opening of the throttle valve $\propto\theta$) which represents a degree of opening of the throttle valve 4, an intake air pipe pressure value Pb' (a detected intake air pipe pressure $\propto$ Pb') which represents an intake air pipe pressure and a cooling water temperature value WT (a detected cooling water temperature $\propto$ WT) which represents the temperature of the cooling water 8, these values being all in digital values.

An ON/OFF signal of the switch 12 for air conditioner is transduced in a digital signal level at the third input interface circuit 103 and the transduced digital signal is inputted to the input port 204.

The CPU 200 calculates a bypass air controlled quantity (for each 100 ms) and a driving time for fuel injector on the basis of the input data. It also conducts time measurement through the timer 208 with a duty ratio which corresponds to a bypass air controlled quantity in synchronism with the generation of the interruption command signal, and it measures through the timer 202 a time corresponding to a fuel injection quantity. During measuring operations by the timers 202, 208, a driving command is applied from the CPU 200 through the output port 207 to the output interface circuit 104. By the driving command, the output interface circuit 104 supplies the driving signal having the above-mentioned duty ratio to the ISC solenoid valve 13 so that the degree of opening of the solenoid valve 13 is controlled, or the interface circuit 104 supplies the driving signal to the fuel injector 15 so that the fuel injector is actuated for the calculated fuel injector driving time $\tau$.

The first power source circuit 105, when the key switch 27 is in an ON state, supplies a fixed voltage from the battery 26 to the microcomputer 100, whereby the microcomputer 100 is started. The above-mentioned control unit 25 is constituted by the components indicated by reference numerals 100–105.

The operation of the first embodiment of the present invention will be described with reference to FIG. 3.

Figure 4:
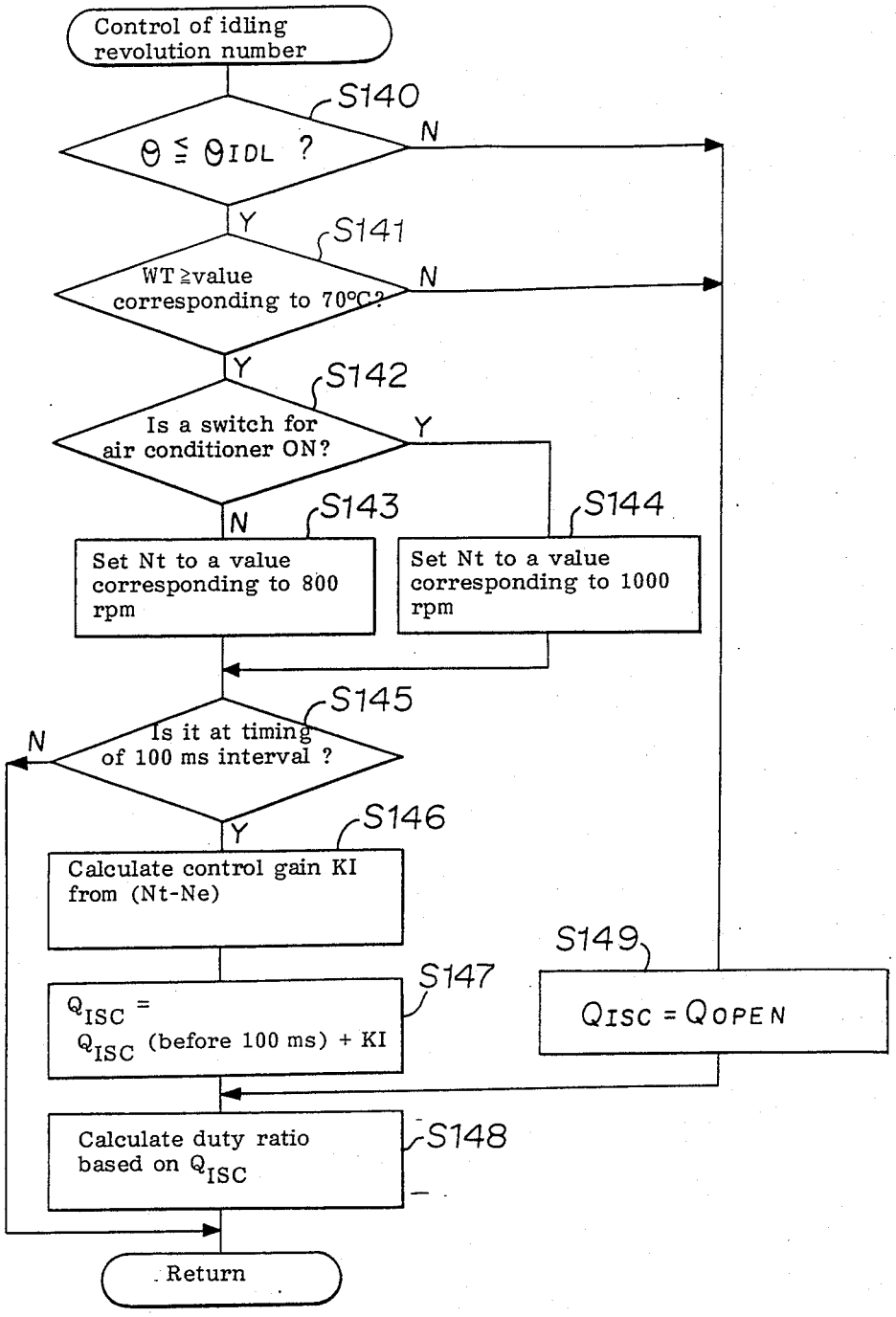
FIG. 4 is a flow chart showing a routine of idling revolution number control in the first embodiment of the present invention.
Figure 5:
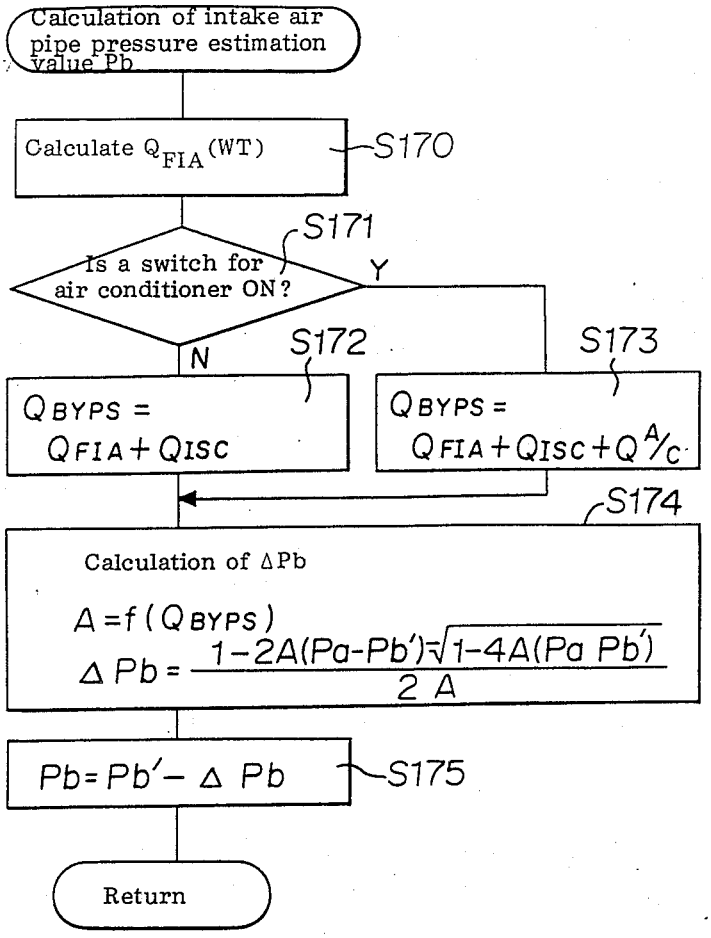
FIG. 5 is a flow chart showing a routine of calculating an intake air pipe pressure estimation value in the first embodiment.

At Step S10, an actual revolution number Ne representing engine revolution speed is obtained on the basis of the period of revolution already detected by an ignition signal from the ignition coil 16. At Step S11, an intake air pipe pressure value Pb' representing an intake air pipe pressure detected by the pressure sensor 14 is read. At Step S12, a cooling water temperature value WT representing a cooling water temperature detected by the water temperature sensor 23 is read. At Step S13, a throttle valve opening degree value $\theta$ representing a degree of opening of the throttle valve, detected by the throttle sensor 5 is read. At Step S14, a treatment of idling revolution number control which is shown in detail in FIG. 4 is conducted on the basis of the previously read data Ne, WT, $\theta$ and ON/OFF signal of the switch 12 for air conditioner. At Step S15, determination is made as to whether or not the throttle valve opening degree value $\theta$ reaches a predetermined opening degree value $\theta_{WOT}$ indicating, for instance, a degree of opening which is in a nearly full open state of the throttle valve 4, namely, whether or not the throttle valve 4 is nearly fully opened. When the throttle valve 4 is in the nearly full open state, the intake air pipe pressure value Pb' is set to an atmospheric pressure value Pa because the previously read intake air pipe pressure value Pb' represents the atmospheric pressure. If not the case, or the treatment of the step S16 has been finished, operation goes to Step S17. At Step S17, an intake air pipe pressure estimation value Pb representing an actual intake air pipe pressure is calculated on the basis of the effective cross-sectional area value of ISC passage $Q_{ISC}$ determined by the ISC solenoid valve 13 obtained at Step S14, the atmospheric pressure value Pa obtained at Step S16 and previously read data: WT, Pb' and the ON/OFF signal of the switch 12. The detail of the treatment of Step S17 is shown in FIG. 5. At Step S18, a volumetric efficiency $C_{EV}$(Ne, Pb) is obtained by mapping a two-dimensional map which is prepared on the basis of the intake air pipe pressure estimation value Pb calculated at Step S17 and the previously read revolution number data Ne. At Step S19, an engine warming-up increment coefficient $C_{WT}$(WT) is obtained by mapping one-dimensional map prepared on the basis of the previously read cooling water temperature value WT. At Step S20, a driving time $\tau$ for driving the fuel injector 15 is obtained in accordance with an equation $\tau = K \times pb \times C_{EV} \times C_{WT}$ by using a constant K, the intake air pipe pressure estimation value Pb calculated at Step S17, the volumetric efficiency $C_{EV}$ calculated at Step S18 and the engine warming-up increment coefficient $C_{WT}$ calculated at Step S19. After the treatment of Step S20, sequential operation is returned to Step S10 so as to repeat the above-mentioned operations.

The detail of the treatment of Step S14 in FIG. 3 will be described with reference to FIG. 4.

At Step S140, determination is made as to whether or not the throttle valve opening degree value $\theta$ is lower than an idling opening degree value $\theta_{IDL}$, i.e., whether or not the throttle valve 4 is at an idling position. When the throttle valve opening degree value $\theta$ is lower than the idling opening degree value $\theta_{IDL}$, i.e. the throttle valve 4 is at the idling position, the sequential step goes to Step S141. At Step S141, determination is made as to whether or not the cooling water temperature value TW is higher than a value corresponding to 70° C., i.e. whether or not the engine 1 is sufficiently warmed. When it is found that the engine is sufficiently warmed, then, sequential step goes to S142. At Step S142, determination is made as to whether or not the switch 12 for air conditioner is ON, i.e. whether or not the air conditioner (not shown) is driven by the engine 1. When the switch 12 for air conditioner is not an ON state, a target revolution number Nt representing a target revolution number is set to a value corresponding to 800 rpm at Step S143. On the other hand, when the Switch 12 is ON, the target revolution number is set to a value corresponding to 1000 rpm at Step S144. At Step S145, determination is made as to whether or not a timing of 100 ms interval is determined. If not the case, the treatment of the idling revolution number control is finished. When it is the case, then, Step S146 is taken. At Step S146, an error $\Delta N$ of the target revolution number Nt to the actual revolution number is obtained. Then, a control gain KI to converge the actual engine revolution number to the target revolution number is obtained by mapping the one-dimensional map of $\Delta N$ shown in FIG. 6.

Figure 6:
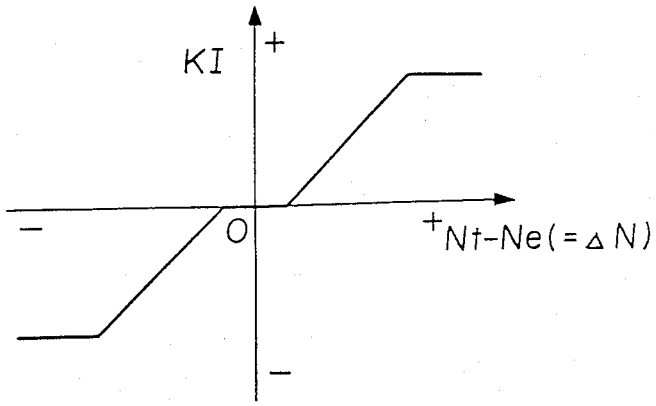
FIG. 6 is a diagram showing a relation of control gains to errors between data of target revolution number and data of actual revolution number.

Relation of $\Delta N$ to KI is such that as shown in FIG. 6, KI moves from 0 in a non-sensitive zone to a proportional region as $\Delta N$ increases or decreases from 0, and when $\Delta N$ further increases or decreases, KI is subjected to a limitation so as not to diverge.

Figure 7:
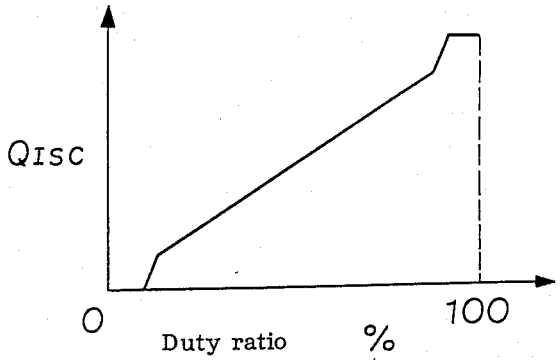
FIG. 7 is a diagram showing duty ratios of driving signal to effective cross-sectional area values of ISC passage.

At Step S147, the effective cross-sectional area value of ISC passage $Q_{ISC}$ is renewed by adding the control gain KI obtained at Step S146 to the previously obtained value (before 100 ms) of the effective cross-sectional area value of ISC passage $Q_{ISC}$ having a value corresponding to a target effective cross-sectional area of the ISC bypass passage 10 varied by means of the ISC solenoid valve 13. At Step S148, a duty ratio for driving signal for the ISC solenoid valve 13 is obtained so that the effective cross-sectional area of target passage is obtained by driving the solenoid valve 13 by mapping the one-dimensional map of $Q_{ISC}$ as shown in FIG. 7 on the basis of the renewed $Q_{ISC}$. Thus, the treatment of idling revolution number control is finished.

Figure 8:
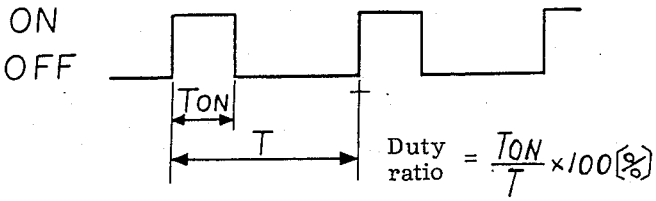
FIG. 8 is a diagram showing the duty ratio.

As shown in FIG. 8, the driving signal has a duty ratio expressed by $T_{ON}/T \times 100$ (%) wherein $T_{ON}$ is a time of one cycle to render the ISC solenoid valve 13 to be turned on and T is a time of one cycle. The duty ratio has a relation in proportion to the degree of opening of the ISC solenoid valve 13.

On the other hand, when the throttle valve 4 is not at the idling position at Step S140, or when judgment is made that the engine is not sufficiently warmed at Step S141, the effective cross-sectional surface area value of ISC passage $Q_{ISC}$ is set to be a predetermined value $Q_{OPEN}$ which is the effective cross-sectional area of target passage at the time of open control at Step S149. After the predetermined value $Q_{OPEN}$ has been set, the same treatment as described above is done at Step S148. Thus, the treatment of idling revolution number control is finished.

In the next place, the treatment of Step S17 as shown in FIG. 3 will be described in detail with reference to FIG. 5.

Figure 9:
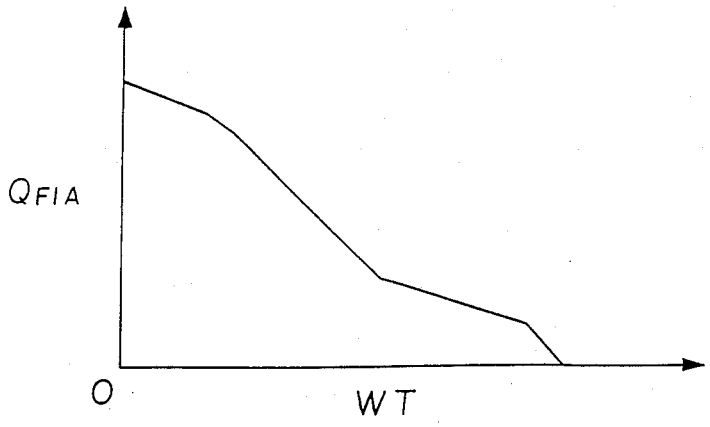
FIG. 9 is a diagram showing a relation of effective cross-sectional area values of FIA passage to cooling water temperature values.

At Step S170, a one-dimensional map of WT as shown in FIG. 9 is prepared on the basis of the previously read data of cooling water temperature value WT. Then, the effective cross-sectional area value $Q_{FIA}$(WT) of FIA passage having a value corresponding to the effective cross-sectional area of the FIA passage 6a (which is given by the FIA valve 7) is obtained. The value of WT is in inverse proportion to the value of $Q_{FIA}$. Namely, as the temperature of the cooling water 8 increases, the FIA valve 7 tends to be closed.

At Step S171, determination is made as to whether or not the switch of air conditioner 12 is ON. When it is not ON, the A/C bypass passage 9 is entirely closed by the ACIUS valve 11. Accordingly, the effective cross-sectional area value of bypass air passage $Q_{BYPS}$ having a value corresponding to the effective cross-sectional area of the bypass air passage 6 is obtained by summing the effective cross-sectional area value of FIA passage $Q_{FIA}$ and the effective cross-sectional area value of ISC passage $Q_{ISC}$ at Step S172. When it is ON, the A/C bypass passage 9 is entirely opened by the ACIUS valve 11. Accordingly, the value $Q_{BYPS}$ is obtained by summing the value $Q_{FIA}$, the value $Q_{ISC}$ and an effective cross-sectional area value of A/C passage $Q_{A/C}$ having a value corresponding to the effective cross-sectional area of the A/C bypass passage 9 at Step S173.

At Step S174, a coefficient A is obtained on the basis of the effective cross-sectional area value of bypass air passage $Q_{BYPS}$ which has already been obtained (in obtaining the coefficient A, when a or k and q are constants, $A=a\times Q_{BYPS}^2$ or $A=k\times(Q_{BYPS}-q)$), and a pressure difference value ΔPb which represents a pressure difference (a pressure loss) between the detected intake air pipe pressure and an estimated intake air pipe pressure is calculated by using the following equation (1):

$$\Delta Pb = \frac{1 - 2A(Pa - Pb') - \sqrt{1 - 4A(Pa - Pb')}}{2A} \quad (1)$$

wherein Pa is an atmospheric pressure value obtained at Step S16 (FIG. 3) and Pb' is an intake air pipe pressure value read at Step S11 (FIG. 3).

At Step S175, an intake air pipe pressure estimation value Pb which represents an actual intake air pipe pressure is calculated from the difference between the intake air pipe pressure value Pb' and the pressure difference value ΔPb. Thus, the treatment of Step S17 is finished.

Figure 10:
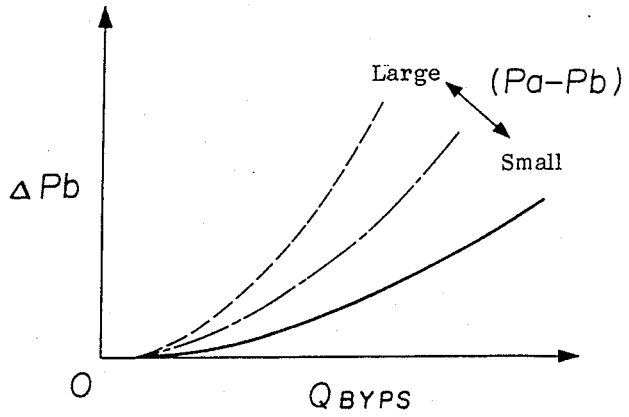
FIGS. 10 and 11 are respectively diagrams showing relations of pressure difference values to effective cross-sectional area values of bypass air passage wherein the difference between an atmospheric pressure value and an actual intake air pipe pressure value is used as a parameter.
Figure 11:
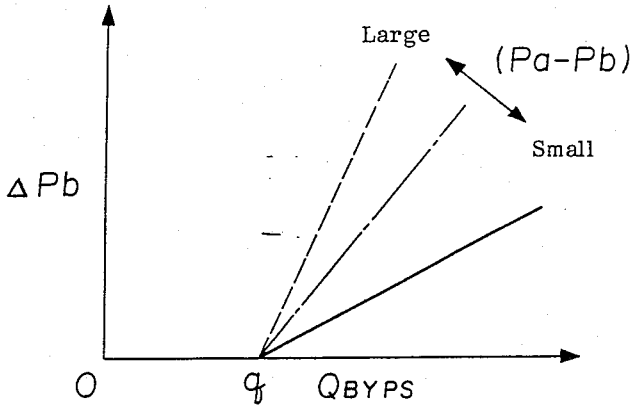

FIGS. 10 and 11 show a results of experiments in order to introduce the above-mentioned equation (1). Each abscissa represents the effective cross-sectional area value of bypass air passage $Q_{BYPS}$ indicating the effective cross-sectional area of the bypass air passage 6 and each ordinate represents the pressure difference value ΔPb between the intake air pipe pressure value Pb' obtained by the pressure sensor 14 and the actual intake air pipe pressure value Pb wherein a pressure difference value Pa−Pb between an atmospheric pressure value Pa and an actual intake air pipe pressure value Pb is used as a parameter. The actual intake air pipe pressure value Pb is obtained by detecting the intake air pipe pressure at the exterior side of the outlet port of the bypass air passage 6 with the same sensitivity and gain as those when the intake air pipe pressure value Pb' is detected.

In FIG. 10, there is shown a change in a parabolic form so that a relation of $\Delta Pb=a\times Q_{BYPS}^2\times(Pa-Pb)^2$ is established. When Pb is eliminated by using $A=a\times Q_{BYPS}^2$ and $\Delta Pb=Pb'-Pb$, the above-mentioned equation (1) is established.

In FIG. 11, $Q_{BYPS}$ and ΔPb are in a relation of prOportion because of $Q_{BYPS}=q$. From the Figure, a relation of $\Delta Pb=k\times(Q_{BYPS}-q)\times(Pa-Pb)^2$ is obtainable. When Pb is eliminated by using $A=k\times(Q_{BYPS}-q)$ and $\Delta Pb=Pb'-Pb$, the above-mentioned equation (1) is established.

Figure 12:
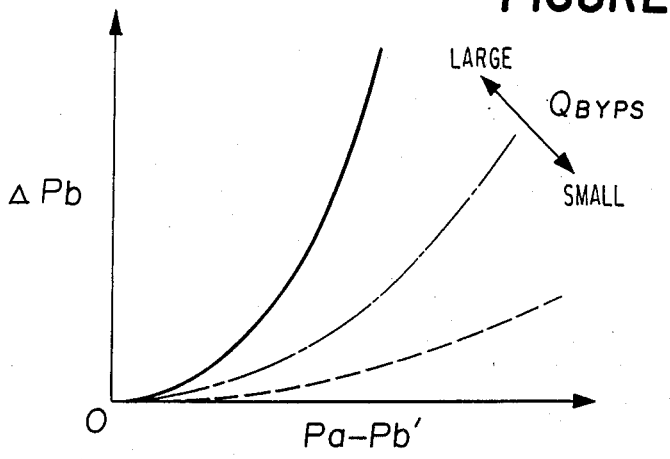
FIG. 12 is a diagram obtained by plotting an equation in relation of difference values between atmospheric pressure values and intake air pipe pressure values to pressure difference values wherein the effective cross-sectional area value of bypass air passage is used as a parameter.

FIG. 12 is obtained by plotting values obtained by using the above-mentioned equation (1) wherein the abscissa represents Pa−Pb', the ordinate represents ΔPb wherein $Q_{BYPS}$ is used as a parameter. In FIG. 12, as the difference between the atmospheric pressure value Pa and the intake air pipe pressure value Pb' becomes greater or the effective cross-sectional area of bypass air passage $Q_{BYPS}$ becomes greater, the pressure difference value between the intake air pipe pressure value Pb' and the intake air pipe pressure estimation value Pb becomes progressively (in a parabolic form) large.

Figure 13:
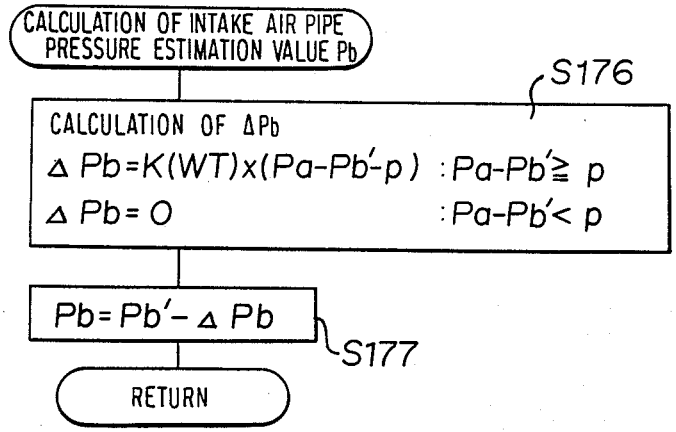
FIG. 13 is a flow chart showing a routine of calculating an intake air pipe pressure estimation value in accordance with a second embodiment of the fuel control apparatus of the present invention.

FIG. 13 shows another embodiment. In this embodiment, an intake air pipe pressure estimation value Pb is obtained by calculation instead of the treatment as shown in FIG. 5. In FIG. 13, ΔPb is calculated by using the following equation at Step S176:

$$\Delta Pb=K(WT)\times(Pa-Pb'-p) \quad (2)$$

wherein the difference between the atmospheric pressure value Pa and the intake air pipe pressure Pb' is more than a predetermined value p. When Pa−Pb' is lower than the predetermined value p, then ΔPb=0. The coefficient K(WT) in the equation (2) is previously stored in a form of a one-dimensional map of the cooling water temperature value TW. At Step S177, an intake air pipe pressure estimation value Pb is calculated from Pb=Pb'−ΔPb. Then, the treatment of FIG. 3 is finished.

Figure 14:
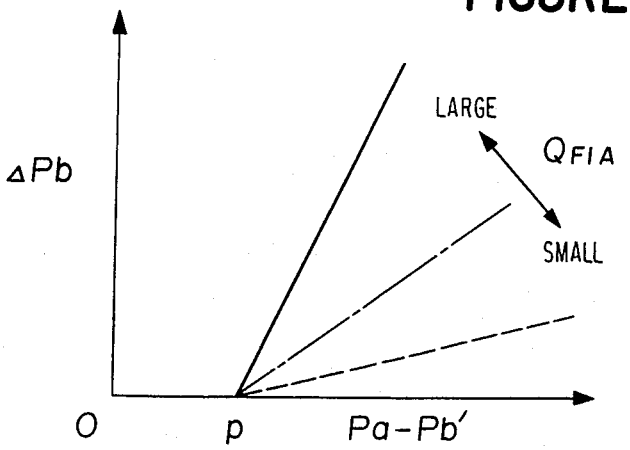
FIG. 14 is a diagram showing a relation of pressure difference values to the difference values between atmospheric pressure values and intake air pipe pressure values of an intake air pipe wherein the effective cross-sectional area value of FIA passage is used as a parameter.

FIG. 14 shows an approximate curve as a result of experiments to introduce the above-mentioned equation (2), wherein the abscissa represents the pressure difference value Pa−Pb' between the atmospheric pressure value Pa and the intake air pipe pressure value Pb', the ordinate represents the pressure difference value ΔPb between the intake air pipe pressure value Pb' and the actual intake air pipe pressure value Pb, and the effective cross-sectional area value of FIA passage $Q_{FIA}$ is used as a parameter. In FIG. 14, when $Pa-Pb'<p$, ΔPb=0, and when $Pa-Pb'\geqq p$, Pa−Pb' is in proportion to ΔPb. The gradient of the line in the proportional relationship becomes large as $Q_{FIA}$ increases (in this case, $Q_{ISC}$ and $Q_{A/C}$ are neglected). Since $Q_{FIA}$ relies on the cooling water temperature value WT, the gradient depends on WT, hence K(WT). Accordingly, when $Pa-Pb'\geqq p$, the relation as in the above-mentioned equation (2) $\Delta Pb=K(WT)\times(Pa-Pb'-p)$ is established.

The equation (2) in the second embodiment allows a quick calculation in comparison with the equation (1) in the first embodiment because the structure of equation is simple.

In the first and second embodiments, the treatment of Step S15 or S16 may be replaced by such measures that an atmospheric sensor for detecting an atmospheric pressure is placed so that a detection value detected by the sensor is read.

Figure 15:
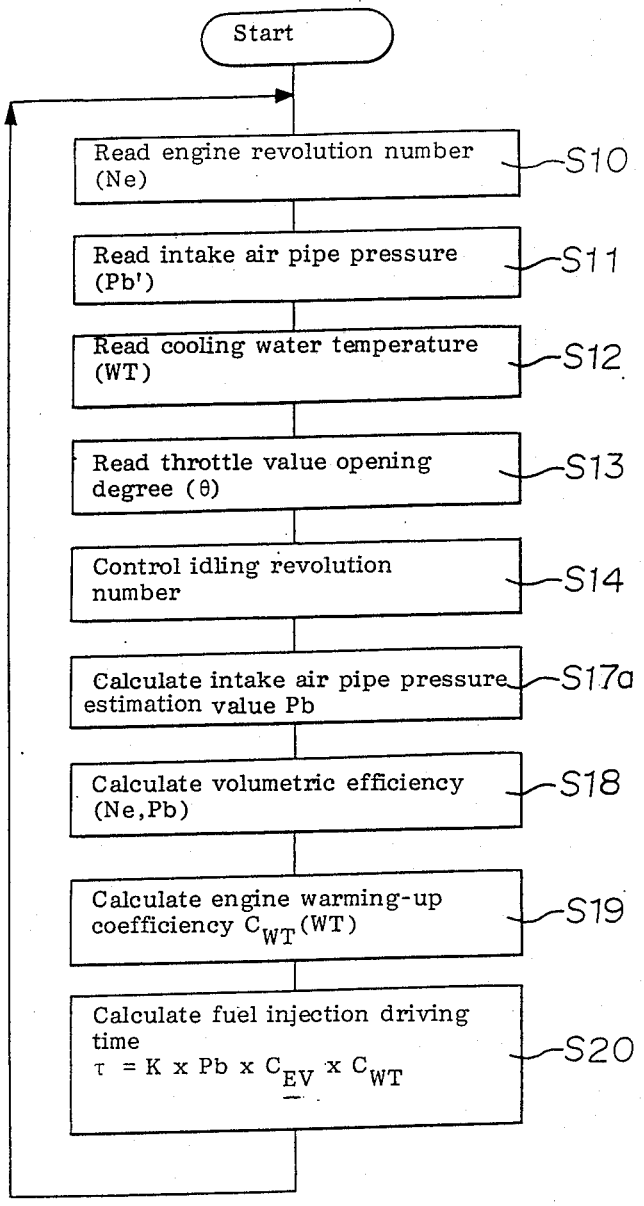
FIG. 15 is a flow chart showing the main operation of the control unit according to a third embodiment of the present invention.

FIG. 15 is a flow chart showing a treatment of the main routine in a third embodiment of the present invention. The main routine is stored in a form of program in a control unit 25 which has the same construction as that in FIG. 1.

In this third embodiment, the treatment of detecting atmospheric pressure which is conducted at Step S15 and Step S16 in the first embodiment (FIG. 3) is eliminated, and instead of this, the atmospheric pressure value is fixed to a previously determined value $P_{760}$ which corresponds to 760 mmHg (one atmospheric pressure) and a treatment of Step S17*a* is executed for Step S17. In FIG. 15, the same reference numerals are used for the same portion of treatment in FIG. 3 and description of these portion is omitted.

At Steps S10–S13, an actual revolution number Ne, an intake air pipe pressure value Pb', a cooling water temperature value WT and a throttle valve opening degree value $\theta$ are successively read.

At Step S14, the same treatment of idling revolution number control as shown in FIG. 4 is executed.

Figure 16:
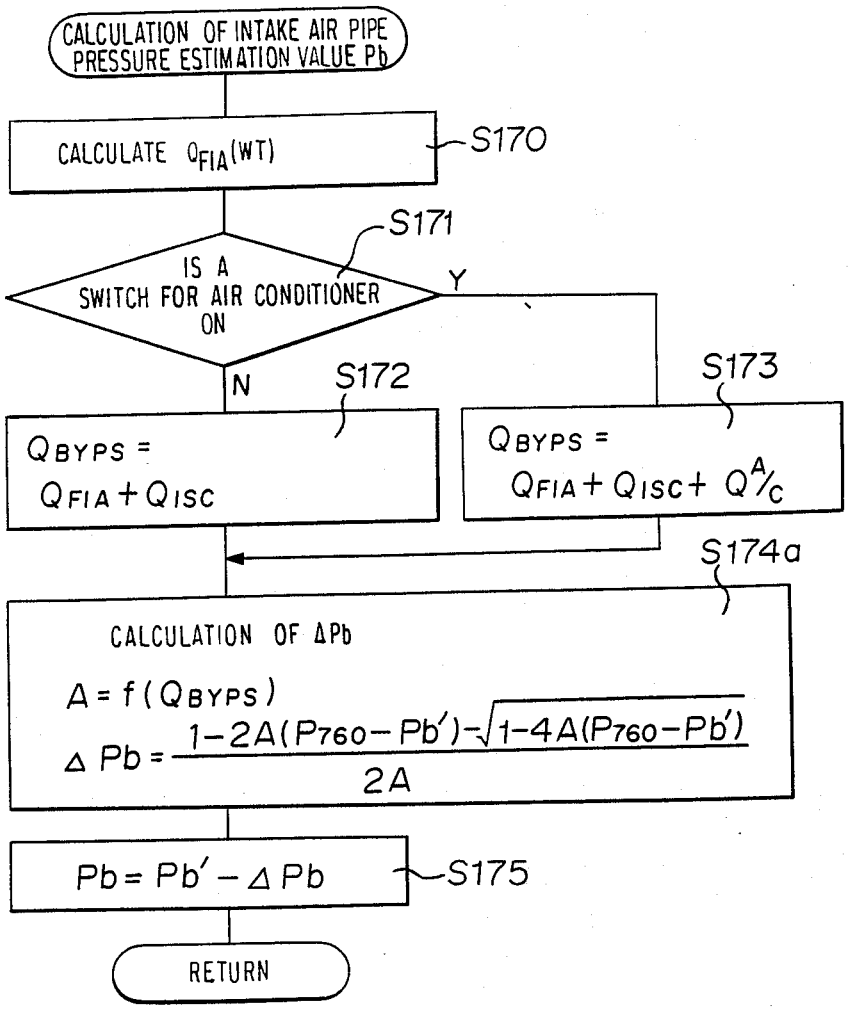
FIG. 16 is a flow chart showing a routine of calculating an intake air pipe pressure estimation value of the third embodiment.

At Step S17*a*, the calculation of an intake air pipe pressure estimation value Pb shown in FIG. 16 is conducted. Then, a volumetric efficiency $C_{EV}$(Ne, Pb) is obtained at Step S18. An engine warming-up increment coefficient $C_{WT}$(WT) is obtained at Step S19. A fuel injector driving time $\tau$ is calculated from an equation of $\tau = K \times Pb \times C_{EV} \times C_{WT}$ at Step S20.

In the next place, a treatment of calculating the intake air pipe pressure estimation value Pb will be described with reference to FIG. 16. In FIG. 16, the same reference numerals as FIG. 5 designate the same treatments, and therefore, description of these parts is omitted. The series of treatment as shown in FIG. 16 is the same as that of FIG. 5 except that a pressure value $P_{760}$ which corresponds to 760 mmHg is used as the atmospheric pressure value Pa at Step S174*a* instead of Step S174 in FIG. 5. Namely, a value ΔPb is obtained by substituting the previously determined value $P_{760}$ for Pa in the above-mentioned equation (1) at Step S174*a*.

Figure 17:
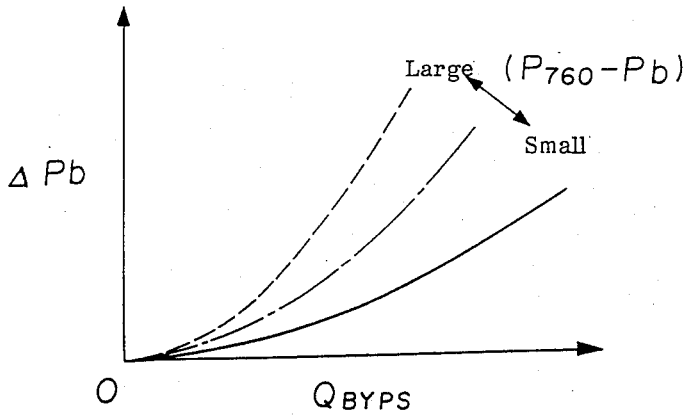
FIGS. 17 and 18 are respectively diagrams showing relations of pressure difference values to effective cross-sectional area values of bypass air passage wherein the difference values between the pressure value corresponding to one atmospheric pressure and actual intake air pipe pressure values are used as parameters.
Figure 18:
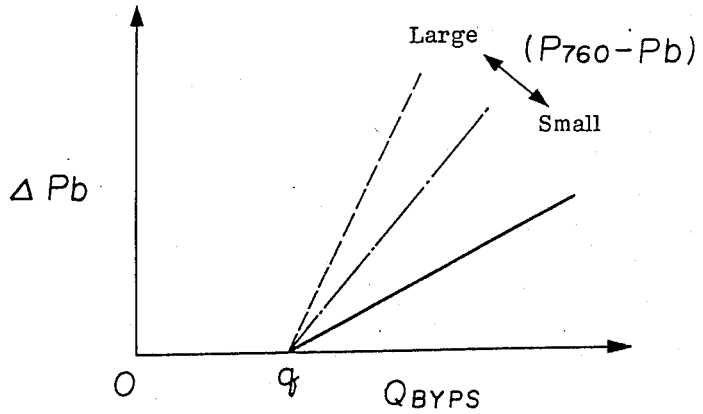

FIGS. 17 and 18 are respectively diagrams showing a result of experiments which are to obtain the equation of ΔPb for Step S174*a* in which a parameter $P_{760} - Pb$ is used instead of the parameter Pa−Pb which is used in the description with reference to FIGS. 10 and 11. In the description concerning FIGS. 10 and 11, if FIG. 10, FIG. 11 and Pa are respectively substituted for FIG. 17, FIG. 18 and $P_{760}$, the equation ΔPb for Step S174*a* is established.

Figure 19:
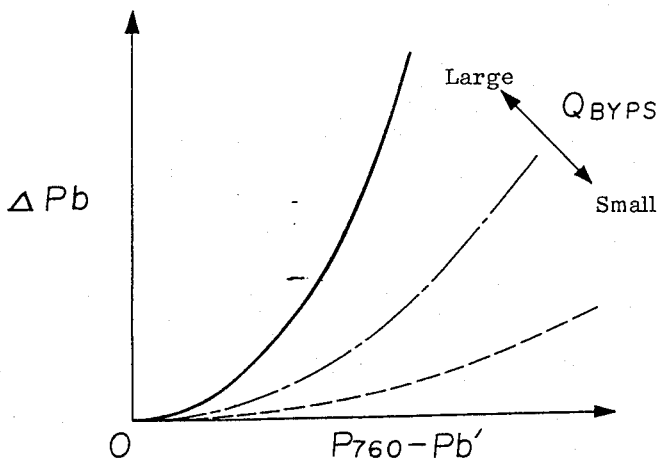
FIG. 19 is a diagram obtained by plotting an equation in a relation of the difference value of the pressure value corresponding to one atmospheric pressure and intake air pipe pressure values to pressure difference values wherein the effective cross-sectional area value of bypass air passage is used as a parameter.

FIG. 19 is a diagram obtained by plotting the equation (1) in which Pa is replaced by $P_{760}$. Pa of the abscissa in FIG. 12 is replaced by $P_{760}$. The curve in FIG. 19 is the same characteristic as that in FIG. 12.

Figure 20:
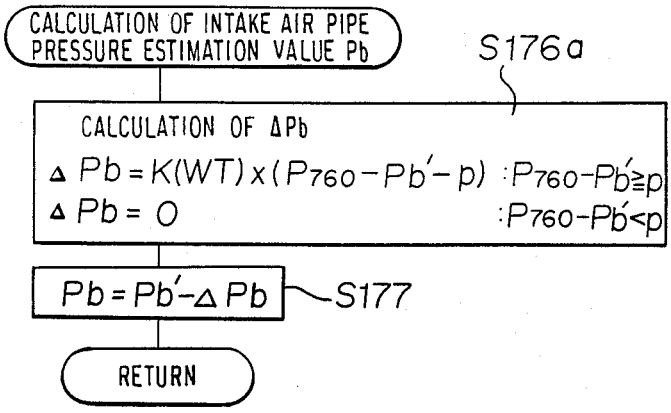
FIG. 20 is a flow chart showing a routine of calculating an intake air pipe pressure estimation value according to a fourth embodiment of the present invention.

FIG. 20 shows a fourth embodiment of the present invention. A series of treatment in the fourth embodiment is the same as that of the second embodiment except that a pressure value $P_{760}$ which corresponds to 760 mmHg is used at Step S176*a* instead of using the atmospheric pressure value Pa at Step S176 in FIG. 13. Namely, at Step S176*a*, when $P_{760} - Pb' \geqq p$, ΔPb is obtained from $\Delta Pb = K(WT) \times (P_{760} - Pb' - p)$. On the other hand, when $P_{760} - Pb' < p$, $\Delta Pb = 0$ is determined. At Step S177, an intake air pipe pressure estimation value Pb is calculated from $Pb = Pb' - \Delta Pb$.

Figure 21:
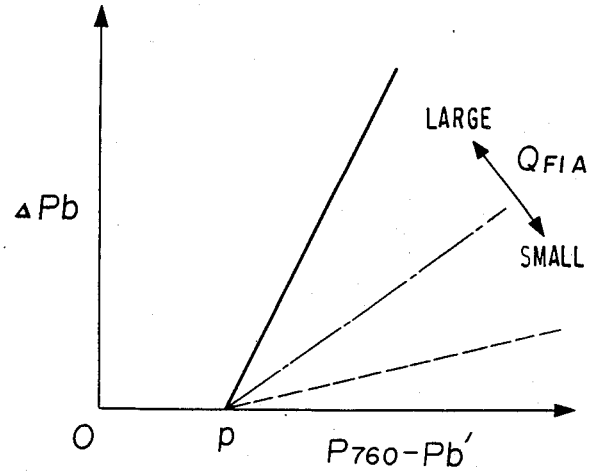
FIG. 21 is a diagram showing a relation of the difference values between the pressure value corresponding to one atmospheric pressure and intake air pipe pressure values wherein the effective cross-sectional area value of FIA passage is used as a parameter.
Figure 22:
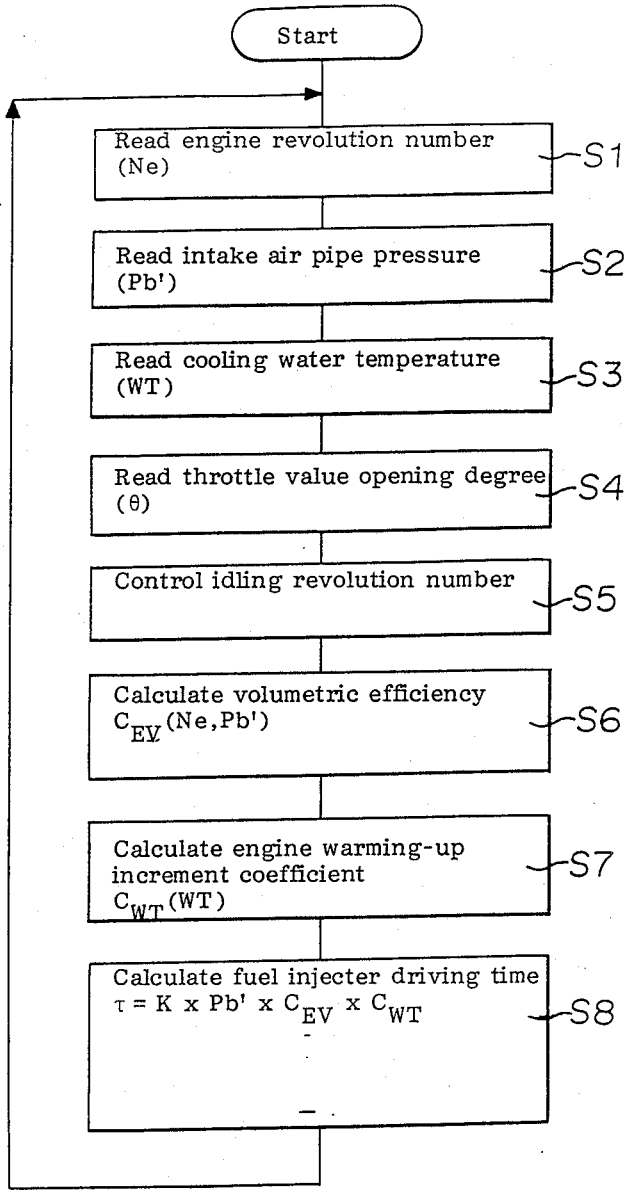
FIG. 22 is a flow chart showing the main operation of a conventional control unit.

FIG. 21 is a diagram showing a result of experiments to obtain the equation of ΔPb at Step S176*a*. The diagram is the same as that of FIG. 14 except that $P_{760} - Pb$ is substituted for Pa−Pb' in the abscissa. Accordingly, the equation of ΔPb for Step S176*a* is obtainable by substituting FIG. 21 for FIG. 14 and $P_{760}$ for Pa in the description of FIG. 14.

In the fourth embodiment, ΔPb can be quickly obtained in comparison with the third embodiment because the equation of ΔPb is simplified.

In the above-mentioned embodiments, the ISC solenoid valve may be of any type so long as an effective cross-sectional area can be estimated, such as a stepper motor driven type valve.

Further, it is possible to estimate the intake air pipe pressure value in the same manner as the above-mentioned embodiments in a case that the ISC solenoid valve also serves the function of the FIA valve or the ACIUS valve.

Thus, in accordance with the present invention, an intake air pipe pressure is estimated on the basis of a pressure detection value which is obtained by detecting a pressure in a bypass air passage and an estimated value of the effective cross-sectional area of the passage, and a fuel injection quantity is calculated on the basis of the estimated value of the intake air pipe pressure. Accordingly, a pressure sensor can be protected from water or fuel which tends to enter into it, and an appropriate air-fuel ratio can be always obtained. Further, good fuel consumption efficiency and drivability can be kept suitably.

Further, calculation of the fuel injection quantity by the estimation of the intake air pipe pressure by using an atmospheric pressure value allows obtaining an appropriate air-fuel ratio regardless of whether the vehicle runs in a high land or a low land.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control apparatus for an internal combustion engine which comprises:

a pressure detecting means for detecting a pressure in a bypass air passage which bypasses a throttle valve in an air intake system for an internal combustion engine, a first estimating means for estimating a value corresponding to the effective cross-sectional area of the bypass air passage, a second estimating means for estimating a pressure in an intake air pipe of the air intake system on the basis of a pressure value detected by the pressure detecting means and an estimated value of effective cross-sectional area obtained by the first estimating means, and an operating means for calculating a fuel injection quantity on the basis of an estimated value of pressure in the intake air pipe which is obtained by the second estimating means.

2. The fuel control apparatus according to claim 1, which further comprises an atmospheric pressure detecting means for detecting an atmospheric pressure wherein the second estimating means estimates a pressure in the intake air pipe of the air intake system on the basis of an atmospheric pressure value detected by the atmospheric pressure detecting means, the pressure value detected by the pressure detecting means and the estimated value of effective cross-sectional area.

* * * * *